US010189697B2

(12) United States Patent
Dean et al.

(10) Patent No.: US 10,189,697 B2
(45) Date of Patent: Jan. 29, 2019

(54) BIG BOTTLE FORMAT DISPENSER

(71) Applicant: BBF Creation LLC, San Diego, CA (US)

(72) Inventors: Aaron Dean, San Diego, CA (US); Jeffrey Brill, Miami, FL (US); John Koutsoumpas, III, Chevy Chase, MD (US); John T. Koutsoumpas, Jr., Chevy Chase, MD (US); Christian Koutsoumpas, Chevy Chase, MD (US)

( * ) Notice: Subject to any disclaimer, the term of this patent is extended or adjusted under 35 U.S.C. 154(b) by 0 days.

(21) Appl. No.: 15/267,290

(22) Filed: Sep. 16, 2016

(65) Prior Publication Data

US 2017/0081166 A1 Mar. 23, 2017

Related U.S. Application Data

(60) Provisional application No. 62/220,689, filed on Sep. 18, 2015.

(51) Int. Cl.

| | |
|---|---|
| ***B67D 3/00*** | (2006.01) |
| ***B65D 47/30*** | (2006.01) |
| ***B65D 23/10*** | (2006.01) |

(52) U.S. Cl.

CPC ..... *B67D 3/0096* (2013.01); *B65D 23/10* (2013.01); *B65D 47/30* (2013.01); *B67D 3/0067* (2013.01)

(58) Field of Classification Search

CPC ..... B67D 1/0872–1/0877; B67D 7/86; B67D 3/0096; B67D 3/0067; B65D 51/248

See application file for complete search history.

(56) References Cited

U.S. PATENT DOCUMENTS

| | | | | | |
|---|---|---|---|---|---|
| 23,455 | A * | 4/1859 | Dickinson | F25D 3/08 | 222/130 |
| 122,384 | A * | 1/1872 | Higgins | B67D 1/0867 | 222/130 |
| 262,773 | A * | 8/1882 | Hoel | F25D 3/08 | 222/130 |
| 371,713 | A | 10/1887 | Smith | | |
| 409,292 | A * | 8/1889 | Levy | F25D 3/08 | 222/130 |
| 470,745 | A * | 3/1892 | Conant | B67D 3/0009 | 220/592.02 |
| 488,473 | A * | 12/1892 | Fruen | B67D 3/0009 | 141/311 R |
| 508,326 | A * | 11/1893 | Lippincott | F25D 3/08 | 222/130 |
| 532,731 | A * | 1/1895 | Helmer | F25D 3/08 | 222/130 |
| 581,085 | A * | 4/1897 | Ruppert | B67D 1/0867 | 137/526 |

(Continued)

*Primary Examiner* — Frederick C Nicolas
*Assistant Examiner* — Randall Gruby
(74) *Attorney, Agent, or Firm* — Lehrman Beverage Law, PLLC

(57) ABSTRACT

A big bottle format dispenser includes a housing in the form factor of a large bottle, the housing defining an outer reservoir. An inner reservoir is carried within the housing. The inner reservoir is filled with an alcoholic beverage, and the outer reservoir is not filled with an alcoholic beverage. An illumination means within the dispenser illuminates the inner reservoir, which in some embodiments is constructed in the form factor of, or contains portions in the form factor of, a company name, logo, symbol, or other branding indicator.

11 Claims, 7 Drawing Sheets

(56) References Cited

U.S. PATENT DOCUMENTS 793,509 A * 6/1905 Cooke ..... F25D 3/08 137/375
793,597 A * 6/1905 Major ..... F25D 23/062 217/129
1,241,353 A * 9/1917 Doering ..... B67D 7/3209 137/377
1,535,927 A * 4/1925 Look ..... F25D 3/08 137/212
1,572,242 A * 2/1926 McLaughlin ..... F25D 3/08 222/130
1,613,248 A * 1/1927 Searing ..... A47J 31/50 222/113
1,645,475 A * 10/1927 Cohen ..... G01F 11/32 222/130
1,654,379 A * 12/1927 Matzka ..... B67D 1/02 222/130
1,656,782 A * 1/1928 Theofanis ..... F25D 3/06 222/130
1,673,007 A * 6/1928 Kaiser ..... B67D 3/00 222/130
1,778,248 A * 10/1930 Doughty ..... B67D 3/00 220/203.23
1,788,442 A * 1/1931 Saugman ..... B67D 3/0009 222/130
1,834,672 A * 12/1931 Austin ..... B67D 3/00 222/108
1,934,427 A * 11/1933 Hinz ..... F25D 23/126 222/130
2,176,988 A 4/1938 Cameron
2,158,633 A * 5/1939 Normandi ..... A47G 19/2227 283/56
2,163,491 A * 6/1939 Kauffman ..... F25D 31/006 137/323
2,514,558 A * 7/1950 Pinanski ..... B67D 1/0877 222/185.1
2,562,212 A * 7/1951 Rogers ..... G07F 13/00 222/113
2,663,866 A * 12/1953 Simpson ..... A47G 19/2227 200/51.12
D240,240 S * 6/1976 Orenstein ..... D21/610
4,976,057 A 12/1990 Bianchi
4,980,807 A * 12/1990 Von Kohorn ..... A01G 9/02 362/122
5,222,631 A * 6/1993 Hood ..... B67D 1/0835 222/131
D379,284 S 5/1997 Credle, Jr.
5,715,700 A 2/1998 Credle, Jr.
5,769,680 A * 6/1998 Hoffman ..... A47G 19/2227 206/217
5,909,826 A 6/1999 Credle, Jr.
D416,481 S * 11/1999 Densmore ..... D9/608
5,996,781 A * 12/1999 Glaser ..... A47G 19/2227 206/217
6,036,570 A * 3/2000 Nadel ..... A47G 19/2227 446/242
6,098,794 A * 8/2000 Lin ..... A47G 19/2227 206/217
6,140,932 A * 10/2000 Frank ..... A47G 19/2227 206/217
6,158,870 A * 12/2000 Ramirez ..... A61J 9/0607 215/11.1
6,186,637 B1 * 2/2001 Murrietta ..... A61J 9/00 362/101
6,276,566 B1 * 8/2001 Zaksenberg ..... A45D 34/00 222/78
6,286,719 B1 9/2001 Haines
6,290,667 B1 * 9/2001 Cook ..... A61M 1/0003 128/200.22
D459,986 S * 7/2002 Yourist ..... D9/607
6,511,196 B1 * 1/2003 Hoy ..... A47G 19/2227 362/101
D472,461 S * 4/2003 Yourist ..... D9/607
6,786,361 B2 9/2004 Moothart
6,921,179 B2 * 7/2005 Diak Ghanem ... A47G 19/2227 206/217
D535,521 S * 1/2007 Burns ..... D7/301
7,175,294 B1 * 2/2007 Estrada ..... A47G 19/2227 362/101
7,771,073 B2 * 8/2010 Chen ..... A47G 19/2227 362/101
7,976,177 B2 * 7/2011 Dikopf ..... A47G 19/2227 206/457
8,087,809 B2 1/2012 Tikhman
8,373,574 B2 2/2013 Gebhard
D712,272 S * 9/2014 Veletakos ..... D9/601
D718,636 S * 12/2014 Manderfield, Jr. ..... D9/527
D730,695 S * 6/2015 Lin ..... D7/516
D777,517 S * 1/2017 Anzalone ..... D7/507
9,593,841 B2 * 3/2017 Sutton ..... F21V 33/0024
2003/0090891 A1 * 5/2003 Wang ..... A47G 19/2227 362/101
2003/0090892 A1 * 5/2003 Su ..... A47G 19/2227 362/101
2004/0218402 A1 * 11/2004 Jao ..... A45D 33/32 362/555
2005/0194005 A1 * 9/2005 Berube ..... A61M 15/009 128/200.14
2005/0207141 A1 * 9/2005 Boesch ..... A47G 19/2227 362/101
2005/0236423 A1 * 10/2005 VanGordon ..... B05B 15/37 222/78
2006/0207679 A1 * 9/2006 Ross ..... B67D 1/06 141/94
2006/0274527 A1 * 12/2006 Langone ..... A47G 19/2227 362/276
2009/0321375 A1 12/2009 Tikhman
2010/0288791 A1 * 11/2010 Myyrylainen ..... B67D 1/0009 222/113
2014/0175122 A1 * 6/2014 Crawford ..... B05B 11/0037 222/78
2015/0092396 A1 4/2015 Jordan

* cited by examiner 70
22*
21*
17*
16*
26*
15*
12*
11*
23*
30*
20*
71
72
40*
24*
46*
43*
42*
41*
44*
52*
51*
50*
14*
13*

70
22*
21*
17*
16*
15*
11*
23*
12*
30*
31*
32*
35*
18*
26*
27*
25*
43*
24*
40*
46*
42*
41*
44*
45*
18*
53
14*
50*
13*

BIG BOTTLE FORMAT DISPENSER

CROSS-REFERENCE TO RELATED APPLICATIONS

This application claims the benefit of U.S. Provisional Application No. 62/220,689, filed Sep. 18, 2015, which is hereby incorporated by reference.

FIELD OF THE INVENTION

The present invention relates generally to beverages, and more particularly to ornamental beverage dispensers.

BACKGROUND OF THE INVENTION

Beverage dispensers have been in use for millennia. Relatively recently, liquor has been packaged in bottles. Government rules have regulated the size of such bottles relative to their volumes. In the US, under 27 C.F.R. § 5.47(a), authorized standards of fill for distilled spirits containers, other than cans, are 1.75 liters, 1 liter, 750 milliliters, 375 milliliters, 100 milliliters, and 50 milliliters.

Any bottle, of course, has only a limited capacity and a corresponding limited amount of exterior surface area. Thus, the manufacturer or distiller is limited in the amount of advertising that it can place on a bottle. Even the largest size of 1.75 liters does not have much exterior surface area and thus does not provide much space for branding the product. This problem is compounded for smaller sized bottles which have minimal branding space.

Unfortunately, the government regulations that limit the fill of a bottle also necessarily limit the amount of branding space. While some bottle manufacturers have created wide-body bottles that present a larger front to the prospective, such bottles present only slightly more branding "real estate" than other conventional bottles. Therefore, a bottle that provides additional branding space, while conforming to federal regulations on liquor volume, is needed.

SUMMARY OF THE INVENTION

A big bottle format dispenser solves the need to provide increased branding space even in smaller liquor bottles. The dispenser includes a housing in the form factor of a large bottle, the housing defining an outer reservoir. An inner reservoir is carried within the housing. The inner reservoir is filled with an alcoholic beverage, but the outer reservoir is not filled with an alcoholic beverage. Instead, the outer reservoir is filled with air, water, or some other non-alcoholic fluid. An illumination means within the dispenser illuminates the inner reservoir, which in some embodiments is constructed in the form factor of, or contains portions in the form factor of, a company name, logo, symbol, or other branding indicator.

BRIEF DESCRIPTION OF THE DRAWINGS

Referring to the drawings.

DETAILED DESCRIPTION

Figure 1A:
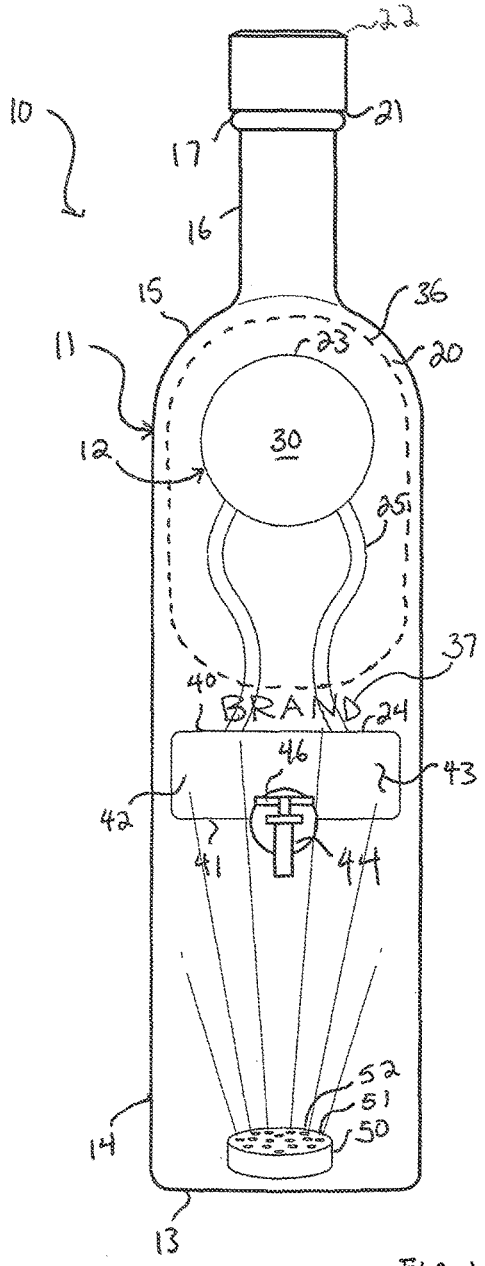
FIGS. 1A and 1B are front and right side elevation views of an embodiment of a big bottle format dispenser, respectively.
Figure 1B:
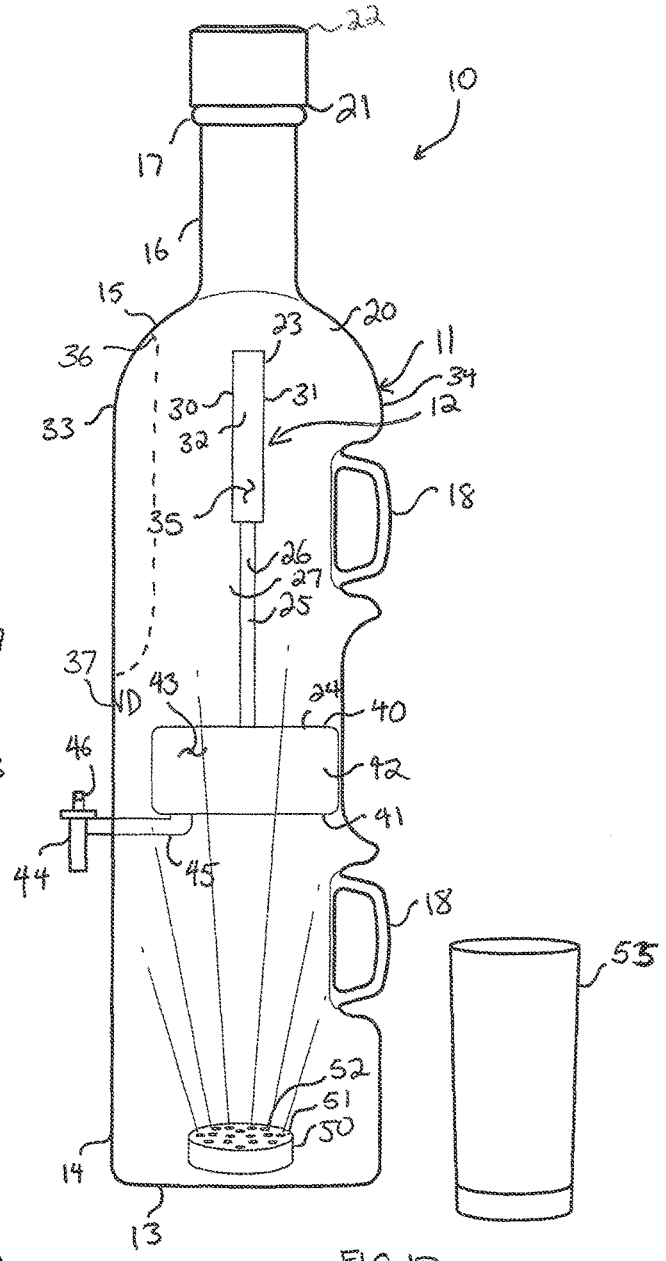

Reference now is made to the drawings, in which the same reference characters are used throughout the different figures to designate the same elements. FIGS. 1A and 1B illustrate a big bottle format dispenser 10 in front and right side elevation views, respectively. The dispenser 10 is a novel solution to the problem of conventional liquor bottles presenting a relatively small surface area for advertising and branding by packaging, placing, or containing an alcoholic-beverage containing reservoir within a non-beverage, or non-alcoholic-beverage containing, reservoir that provides more surface area.

The dispenser 10 includes an enclosed housing 11 defining an outer reservoir and an inner reservoir 12 carried and generally suspended within the housing 11. The housing 11 has a generally standard "big bottle format" and the inner reservoir has a unique arrangement which generally corresponds to the branding or some aesthetic characteristic desired by the dispenser 10 manufacturer, or more likely, the distiller whose alcohol will be displayed in and dispensed from the dispenser 10.

The housing 11 has a big bottle format. A big bottle format is a large bottle, generally much larger than conventional 1.75 liter bottles. For instance, a big bottle format stands generally at approximately three feet tall. The housing 11 has a wine bottle form factor, which means it is characterized by the proportions, shape, and arrangement of a conventional wine bottle, though not the size. Further, a big bottle format has a flat bottom 13, a generally cylindrical body 14, a shoulder 15 which tapers to a slender neck 16, and a top 17. Handles 18 are formed monolithically and integrally to the body 14. One having ordinary skill in the art will readily appreciate, given the variety of bottle designs for 1.75 liter bottles, that a big bottle format may deviate from this description slightly, and yet, because of its size much greater than 1.75 liters, will easily be identified as a big bottle format. As a non-limiting example, a big bottle format may be of a size with a capacity of between two liters and five or ten liters, though in some cases, a larger or smaller size may be desired. For instance, a very large celebration may call for a fifteen liter big bottle format bottle as a centerpiece display or piece of artwork that can still dispense smaller, legal quantities of alcohol. This especially allows the inner reservoir 12 to be fragile, delicate, and have ornamentation that would otherwise not be possible were the inner reservoir 12 a stand-alone bottle.

The housing 11 has a sidewall 20 which extends continuously around the housing 11, terminating in an open mouth at the top 17. The mouth is fitted with a cap 22 and a tamper-proof seal 21 to prevent intrusion into the dispenser 10. The cap 22 is preferably threadably engaged to the mouth of the housing 11, and the tamper-proof seal 21 is one of several conventional types, such as a shrink-wrap seal placed over both the cap 22 and the top 17.

The sidewall 20 of the housing 11 is relatively thin and is constructed of a material or combination of materials having characteristics of rigidity, strength, and durability, such as preferably glass or plastic. The sidewall 20 is generally opaque, except as otherwise described herein. In the drawings, the entirety of the inner reservoir 12 is shown through the sidewall 20 for purposes of clarity and illustration, but it should be understood that in some embodiments, much of the inner reservoir 12 is concealed from view by the opaque sidewall 20 except, again, as otherwise described herein.

Within the housing 11 is the inner reservoir 12. The inner reservoir 12 preferably contains an alcoholic beverage, which, together with the configuration and arrangement of the inner reservoir 12, presents an ornamental and artistic display while complying with federal guidelines on liquor fill quantities. In many embodiments, this ornamental and artistic display will have the additional characteristic of marketing, as the configuration and arrangement of the inner reservoir 12 is that of a branding indicator for the manufacturer or distiller. While the inner reservoir 12 is preferably filled with an alcoholic beverage, the housing 11 is preferably not filled with an alcoholic beverage. Indeed, in a preferred arrangement, the inner reservoir 12 contains an alcoholic beverage and the housing 11 contains (but for the inner reservoir 12) a gas such as air. In another arrangement, the inner reservoir 12 contains an alcoholic beverage and the housing 11 contains (but for the inner reservoir 12) a non-alcoholic beverage, such as water. FIG. 1B illustrates the alcoholic beverage with reference character 26, and the fill of the housing 11, which may be a non-alcoholic beverage or a gas, as just explained, with reference character 27.

The inner reservoir 12 is an assembly of parts carried within the housing 11 and includes an upper reservoir 23, a lower reservoir 24, and a tubing set 25 extending between the upper and lower reservoirs 23 and 24. The upper and lower reservoirs 23 and 24 are fluid containment reservoirs, in that they are configured primarily to hold and display fluid such as liquor. The tubing set 25 is a fluid communication system, configured primarily to pass fluid from the upper reservoir 23 to the lower reservoir 24. Nonetheless, in some embodiments described later, the tubing set 25 is configured to hold and display fluid, such as may be desired when the manufacturer or distiller desires showing such elements.

As shown in FIGS. 1A and 1B, the upper reservoir 23 is a disc-shaped reservoir. The upper reservoir 23 is hollow and is defined by a circular front 30 directed toward a front 33 of the dispenser 10, a circular back 31 directed toward a back 34 of the dispenser 10, and an annular sidewall 32 extending therebetween, all cooperating to define an interior space 35 for the upper reservoir 23. The upper reservoir is disposed generally within a plane which vertically bisects the dispenser 10, extending mostly within said plane and extending toward the front 33 and the back 34 only slightly. Thus, the upper reservoir is disc like, has a relatively thin profile, but still presents a relatively large front 30 toward the front 33 of the dispenser 10. The front 30 is approximately half the width of the dispenser 10.

The lower reservoir 24 is a short, squat cylinder generally coaxially disposed within the dispenser 10. The lower reservoir 24 is hollow and is defined by a top 40 directed upward toward the upper reservoir 23, a bottom directed downward toward the bottom 13 of the dispenser 10, and an annular sidewall 42 extending vertically therebetween, all cooperating to define an interior space 43 for the lower reservoir 24. The lower reservoir 24 occupies nearly the entire width of the dispenser 10.

The tubing set 25 extends between the upper and lower reservoirs 23 and 24 and couples them in fluid communication, allowing fluid to pass under the influence of gravity from the upper reservoir 23 to the lower reservoir 24. The tubing set 25 includes two arcuate hollow tubes, coupled to and extending between the upper and lower reservoirs 23 and 24. From the upper reservoir 23, the two tubes diverge arcuately away from each, then turn and converge toward each other proximate to the lower reservoir 25. The tubing set 25 is symmetric with respect to a vertical axis bisecting the dispenser 10, and is generally intermediately positioned horizontally with respect to the upper and lower reservoirs 23 and 24.

Two holes are formed in a lower portion of the sidewall 32 of the upper reservoir 23, and the tops of each of the tubes of the tubing set 25 are integrally formed, such as welded, fused, glued, blown, or otherwise permanently attached to the upper reservoir 23. Likewise, two holes are formed in the top 40 of the lower reservoir 24, and the bottoms of each of the tubes of the tubing set 25 are integrally formed, such as welded, fused, glued, blown, or otherwise permanently attached to the lower reservoir 24. Fluid, such as an alcoholic beverage, contained within the inner reservoir 12, may pass from the interior space 35 of the upper reservoir 23, down through the tubing set 25, and into the interior space 43 of the lower reservoir 24.

Figure 1C:
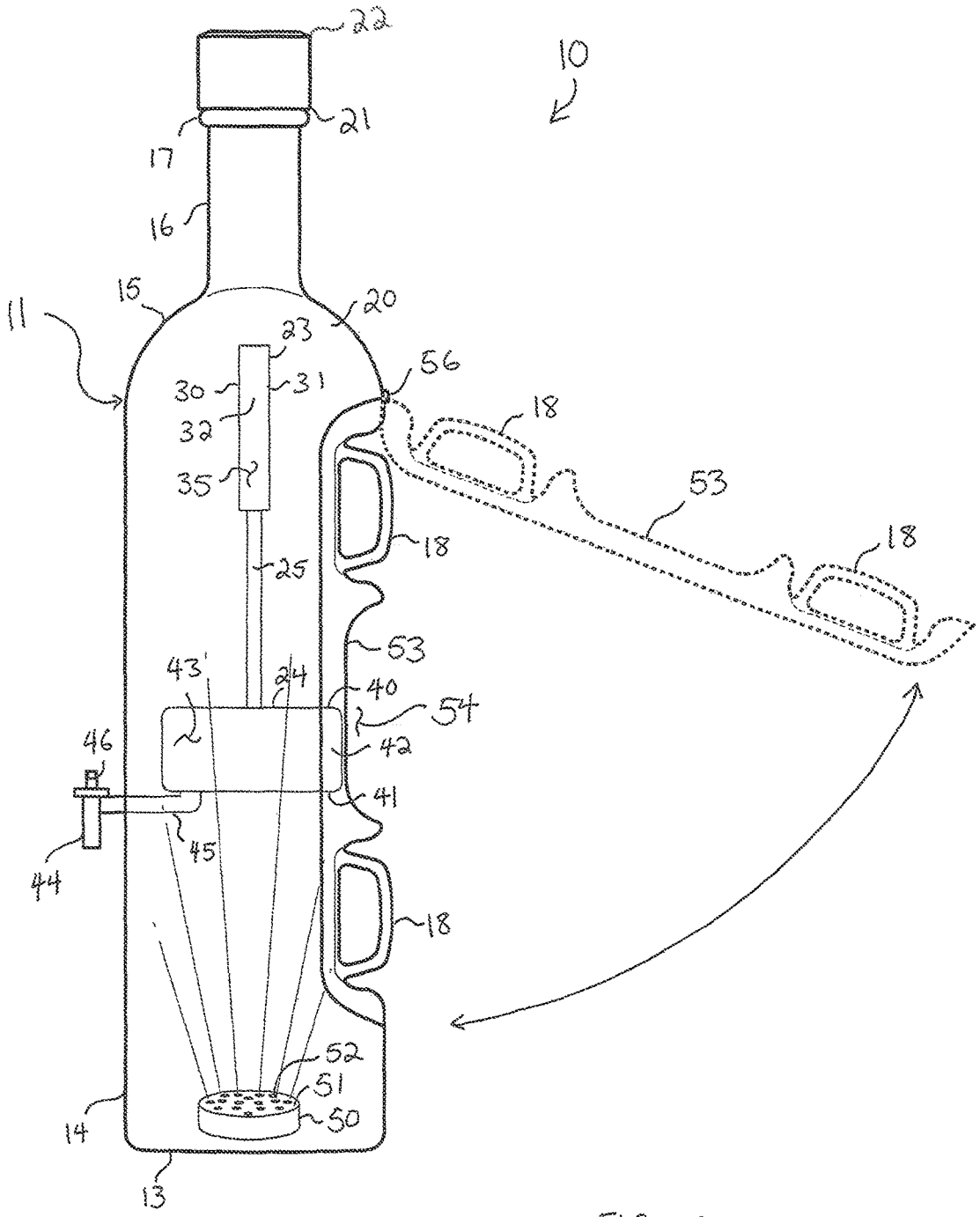
FIG. 1C is a right side elevation view of the big bottle format dispenser of FIGS. 1A and 1B showing handles in two positions.

Just below the lower reservoir 24, a spigot 44 is carried in the sidewall 20. The spigot 44 is coupled in fluid communication with the bottom 41 of the lower reservoir by a tube 45 which allows fluid to pass from the lower reservoir 24 to the spigot. The spigot 44 includes a valve 46, such as a ball valve, for regulating the flow of fluid through the spigot 44, and thereby controllably dispensing the fluid from the dispenser 10. In the embodiment of FIGS. 1A-1C, the spigot 44 is isolated from fluid communication with the housing 11; gas or fluid in the housing 11 cannot pass into or through the spigot 44.

In the embodiment shown in FIGS. 1A and 1B, the inner reservoir 12 is supported within the housing 11 solely by the tube 45 extending between the spigot 44 and the lower reservoir 24. The inner reservoir 12 is preferably constructed from a material or combination of materials having properties alight weight and rigidity, such as plastic or glass. Because the tube 45 is rigid and is firmly secured to the spigot 44 mounted in the sidewall 20, the tube 45 rigidly supports the inner reservoir 12 within the housing 11. Thus, the entire inner reservoir 12 is suspended within the housing 11. Moreover, because the spigot 44 is larger than the tube 45 and because the bottom 41 of the lower reservoir 24 is approximately directly behind the spigot 44, when the dispenser 10 is viewed from the front 33, the tube 45 is concealed from view by the spigot 44, and the inner reservoir 12 appears to float on its own within the dispenser 10. This unique floating arrangement provides manufacturers and distillers the opportunity to present interesting, unique branding displays with the dispenser 10.

With the inner reservoir 12 so suspended within the housing 11, the inner reservoir 12 may be constructed, shaped, and arranged in a visually pleasing manner. The inner reservoir 12 may also be constructed, shaped, and arranged according to a branding identity or the form factor of a branding indicator. As the term is used herein, "branding indicator" is meant to include anything which is capable or meant to identify or distinguish goods or services—or the source of goods or services—from goods or services provided by another source, such as and not limited to, trademarks, service marks, trade dress, product design, packaging designs, and the like. A branding indicator may thus take many shapes and forms. As one example, the upper reservoir 23 may be in the form or a circular label and have writing on the front 30 designating the trademark name of the alcoholic beverage contained within the inner reservoir 12. As another example, the upper reservoir 23, lower reservoir 24, and tubing set 25 may be configured and shaped in a manner, such that, when the dispenser 10 is viewed from a certain perspective, such as directly at the front 33, those portions of the inner reservoir 12 evoke or look identical to the shape of, or decorative aspects of, the trade dress inherent in a manufacturer's more conventional-sized bottle of alcohol. As a further example, the tubing set 25 could evoke the branches of a tree in a manufacturer's trademark logo. Many other examples exist, and the above list of a few examples is meant to illustrate several non-limiting ways in which the inner reservoir 12 can be used to display a branding indicator.

Where the sidewall 20 is opaque, as described above, observation of the inner reservoir 12 may be difficult, though in some cases purposely so. Where intended, the opacity of the sidewall 20 may create the look of mist, fog, or clouds and may evoke mystery, mysticism, crisp snowy air, morning dew, or like aesthetics. The inner reservoir 12 may be obscured or clouded so as to produce a somewhat blurred display. However, in some cases, the manufacturer or distiller may desire a much clearer display of the inner reservoir 12. In such cases, a window 36 is formed in the sidewall 20 at the front 33 of the housing 11. The window 36 is a portion of the sidewall 20 which is substantially or entirely transparent. The bounds of the window 36 are generally identified by broken line in FIG. 1A; one having ordinary skill in the art will readily understand and appreciate that in some embodiments, the window 36 may be slightly shorter, taller, thinner, wider, or have alternate shapes than the rough oval of FIG. 1A, as so desired by the manufacturer or distiller. For instance, in FIGS. 1A-1C, the window 36 is shown as extending approximately from the shoulder 15 of the housing 11 to a location approximately halfway between the shoulder 15 and the bottom 13. The window 36 provides clear visibility through a portion of the sidewall 20 below the neck 16 and above the spigot 44, so that an observer may clearly view the inner reservoir 12, especially the upper reservoir 23, at least a portion of the tubing set 25, and in some embodiments a portion of the lower reservoir 24. This provides manufacturers or distillers with the opportunity to further use the construction, shape, and arrangement of the inner reservoir 12 to create a clear and striking branding display within the housing 11.

In addition to the modifying the construction, shape, and arrangement of the inner reservoir 12 to create a branding display, the inner reservoir 12 may also be illuminated. An illumination means, such as a light 50, is carried in the housing 11 at the bottom 13 thereof. The light 50 is exemplary of one type of illumination means. The illumination means, in other embodiments, includes a chemical glow stick, an LED, an ultraviolet or other light outputting light or radiation beyond the visual spectrum, or some other device which causes the inner reservoir 12—and the fluid contained therein—to illuminate. Further, the word "illuminate" is meant to include not just brighten or light, but also fluoresce (as may occur with ultraviolet or X-ray light radiation), glow, or otherwise become visible. However, for simplicity, the light 50 will be used here as a substitute for "means for illumination," and one having ordinary skill in the art will readily appreciate that the description of the light 50 applies equally to other means for illumination.

The light 50 is disposed at the bottom 13 of the housing 12. Preferably, the light 50 is secured at the bottom 13, such as with an adhesive or within a seat sized and shaped to receive the light 50. The light 50 is puck-shaped, being a low relatively thin round disc. The light 50 has an upper face 51 perforated with holes into which a plurality of light-emitting devices, such as LEDs 52, are set. The LEDs 52 are directed upward, toward the inner reservoir 12, so as to light the inner reservoir 12 from below. When the inner reservoir 12 is filled with a colored liquid, or a liquid that is designed to fluoresce, the inner reservoir 12 will illuminate or fluoresce, in contrast to the empty space within the housing 11. In other words, when the inner reservoir 12 is filled with a beverage and the housing 11 is not filled with a beverage, and the light 50 is energized, the entirety of the inner reservoir 12 is brightly illuminated and is markedly visible, so as to present a bright and attractive branding and advertising display.

Below the window 36, a secondary branding indicator 37 is located. The secondary branding indicator 37 shown in FIGS. 1A and 1B is a brand name, but in other embodiments, the secondary branding indicator 37 is a label, a logo, or some other branding indicator. The secondary branding indicator 37 provides another means and location for branding and advertising the dispenser 10 and the manufacturer or distiller.

In operation, the light 50 is energized in one of several ways. In one embodiment, in which the light 50 is seated or secured to the bottom 13, the light 50 has a manual switch on its exterior which can be moved between off and on positions by one's finger. According to one embodiment of the dispenser 10, shown in FIG. 1C, a panel 53 at the back 34 of the dispenser 10 is hinged at a hinge 56 and pivots away from the housing 11 to open an opening 54 at the back 34 of the dispenser 10. Said opening 54 provides access to the interior of the housing 11 and allows a user to access and handle the inner reservoir 12 and also move the manual switch on the light 50. Additionally, in the embodiment shown in FIG. 1C, the handles 18 are formed to the panel 53, so that the handles 18 are mounted for pivotal movement between a first position away from the back 34 of the housing 10 (as shown in broken line in FIG. 1C) and a second position toward the back 34 of the housing 10 (as shown in solid line in FIG. 1C). In the second position of the panel 53, the panel 53 is impermeably sealed to the back 34 of the housing 10. In another embodiment, the light 50 energizes in response to detection of one of sound, light, movement, and touch. In yet another embodiment, the light 50 is coupled in electronic communication to the spigot 44, and is programmed to energize when the valve 46 on the spigot 44 is opened.

In operation, the dispenser 10 is used to display and dispense an alcoholic beverage from a large, ornamental branding display. The dispenser 10, after purchase, is typically received with the alcoholic beverage already filled in the inner reservoir 12. The dispenser 10 is placed on a high shelf, or on a bar top, or on a countertop for display. The spigot 44 of the dispenser is located at a height on the body 14 such that a conventional sixteen-ounce tall glass 55 can be placed just under the spigot 44 without tipping the glass 55. The light 50 is energized, and the alcoholic beverage within the inner reservoir 12 is illuminated, or fluoresces, from the light 50. When a patron requests a drink, the glass 55 is placed under the spigot 44, the valve 46 is opened, and the alcoholic beverage 26 is dispensed from the inner reservoir 12 through the tube 45 and out the spigot 44. As more of the alcoholic beverage 26 is dispensed, the inner reservoir 12 becomes emptier, until eventually it is completely emptied. When this occurs, the dispenser 10 may be retained and used only as decoration and advertising, or it may be re-filled under certain circumstances. For instance, if the dispenser 10 is of an embodiment with a pivoting panel 53, then the inner reservoir 12 can be accessed and refilled. The dispenser 10 may then be re-used for dispensing and also for decoration and advertising.

Figures 2A, 2B:
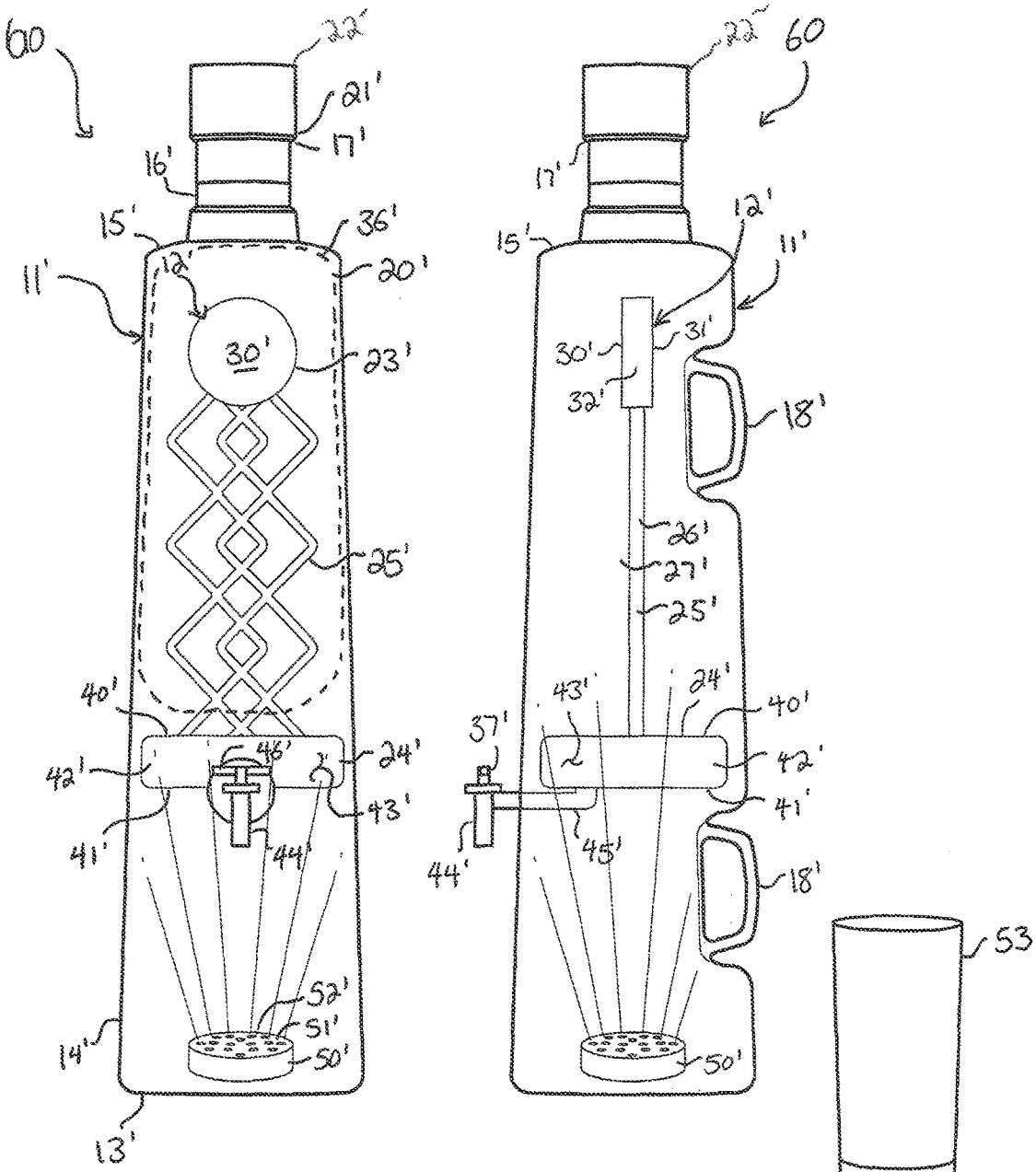
FIGS. 2A and 2B are front and right side elevation views of another embodiment of a big bottle format dispenser, respectively.

FIGS. 2A and 2B are front and right side elevation views, respectively, illustrating an alternate embodiment of a big bottle format dispenser 60 very similar to the dispenser 10. The dispenser 60 is, in fact, nearly identical to the dispenser 10, and, as such, the same reference characters used to identify the various structural elements and features of the dispenser 10 are used to identify identical structural elements and features of the dispenser 60, but are marked with a prime ("") symbol so as to designate and distinguish them from those of the dispenser 10. As such, the dispenser 60 includes a housing 11', inner reservoir 12', bottom 13', body 14', shoulder 15', neck 16', top 17', handles 18', sidewall 20', tamper proof seal 21', upper and lower reservoirs 23' and 24', tubing set 25', alcoholic beverage 26, non-alcoholic fill 27, front 30', back 31', sidewall 32', front 33', back 34', interior space 35', window 36', top 40', bottom 41', sidewall 42', interior space 43', spigot 44', tube 45', valve 46', light 50', upper face 51', and LEDs 52'. For simplicity of the drawings, not all of these structural elements and features are marked. Of course, as FIGS. 2A and 2B clearly show, the configuration of the housing 11' and the inner reservoir 12' is different from that of the housing 11 and the inner reservoir 12 of the dispenser 10. They present very different displays. However, the dispensers 10 and 60 are functionally identical.

The housing 11' has a generally frusto-conical shape, in contrast with the more wine-bottle shape of the housing 11. Further, the tubing set 25' includes approximately four semi-separate tubes which bend angularly at roughly ninety-degree angles back and forth between the upper and lower reservoirs 23' and 24'.

Figures 3A, 3B:
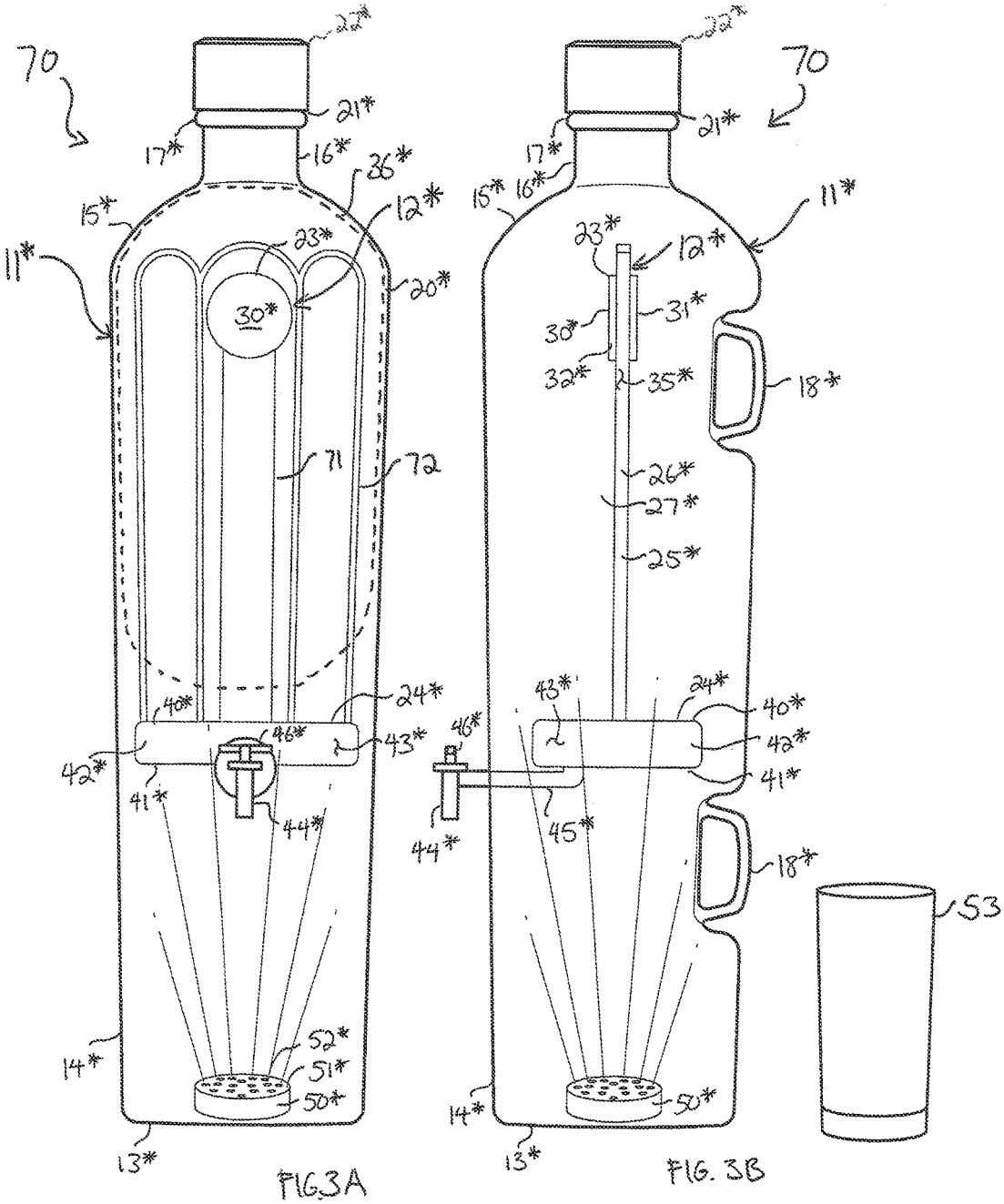
FIGS. 3A and 3B are front and right side elevation views of yet another embodiment of a big bottle format dispenser, respectively.

FIGS. 3A and 3B are front and right side elevation views, respectively, illustrating an alternate embodiment of a big bottle format dispenser 70 very similar to the dispenser 10. The dispenser 70 is, in fact, nearly identical to the dispenser 10, and, as such, the same reference characters used to identify the various structural elements and features of the dispenser 10 are used to identify identical structural elements and features of the dispenser 70, but are marked with an asterisk ("*") so as to designate and distinguish them from those of the dispenser 10. As such, the dispenser 70 includes a housing 11*, inner reservoir 12*, bottom 13*, body 14*, shoulder 15*, neck 16*, top 17*, handles 18*, sidewall 20*, tamper proof seal 21*, upper and lower reservoirs 23* and 24*, tubing set 25*, alcoholic beverage 26, non-alcoholic fill 27, front 30*, back 31*, sidewall 32*, front 33*, back 34*, interior space 35*, window 36*, top 40*, bottom 41*, sidewall 42*, interior space 43*, spigot 44*, tube 45*, valve 46*, light 50*, upper face 51*, and LEDs 52*. For simplicity of the drawings, not all of these structural elements and features are marked. Of course, as FIGS. 3A and 3B clearly show, the configuration of the housing 11* and the inner reservoir 12* is different from that of the housing 11 and the inner reservoir 12 of the dispenser 10. They present very different displays. However, the dispensers 10 and 70 are functionally identical.

The housing 11* has a tapered cylindrical shape, different from the wine bottle shape of the housing 11. Further, the tubing set 25* includes a central main tube 71 which extends from the upper reservoir 23* to the lower reservoir 24* as well as three looped or arched tubes 72 which are only coupled in fluid communication to the lower reservoir 24* but are nonetheless filled with the alcoholic beverage 26*.

FIGS. 4A, 4B, 5A, and 5B are front, right, front, and right side elevation views, respectively illustrating an alternate embodiment of a big bottle format dispenser 80 similar to the dispenser 10. The dispenser 80 is similar enough to the dispenser 10 that the same reference characters used to identify the various structural elements and features of the dispenser 10 are used to identify identical structural elements and features of the dispenser 80, but are marked with a tilde ("~") so as to designate and distinguish them from those of the dispenser 10. As such, the dispenser 80 includes a housing 11~, bottom 13~, body 14~, shoulder 15~, neck 16~, top 17~, handles 18~, sidewall 20~, tamper proof seal 21~, front 33~, back 34~, window 36~, spigot 44~, valve 46~, light 50~, upper face 51~, and LEDs 52~. For simplicity of the drawings, not all of these structural elements and features are marked.

The dispenser 80, instead of including a rigid inner reservoir, has a flexible bladder 81 carried within the housing 11~. And, instead of the housing 11 not containing an alcoholic beverage while the inner reservoir 12 does, here, the housing 11~ does contain an alcoholic beverage 84 and the bladder 81 does not; the bladder 81 more preferably contains a fluid or gas 85, such as water, air, or some other fluid or gas (gas 85 will be referred to herein for simplicity). The bladder 81 is coupled in fluid communication via a line 82 to a pump 83 preferably outside of the dispenser 10. The pump 83 operates to remove or supply fluid to the bladder 81 in response to the level of the alcoholic beverage rising or falling, respectively.

The alcoholic beverage 84 in the housing 11~ has a level 86 which is monitored by a level sensor 87. The level sensor is electronically coupled to the pump 83, and when the level 86 drops on the level sensor 87, or drops below the level sensor 87, the level sensor transmits a signal to the pump 83 to begin operating. The pump, in response, activates and pumps gas 85 into the bladder 81 to fill the bladder 81 with gas 85. The bladder 81 expands to occupy more volume, thus displacing the alcoholic beverage 84 and causing the level 86 of the alcoholic beverage 84 to rise until it reaches or rises along the level sensor 87. Once the level 86 is at a desired level on the level sensor 87, then the level sensor 87 issues an instruction to the pump 83 to cease operating. The pump 83 stops operating, but holds the pressure in the line 82 so that the bladder 81 does not reduce in size.

Figure 4A:
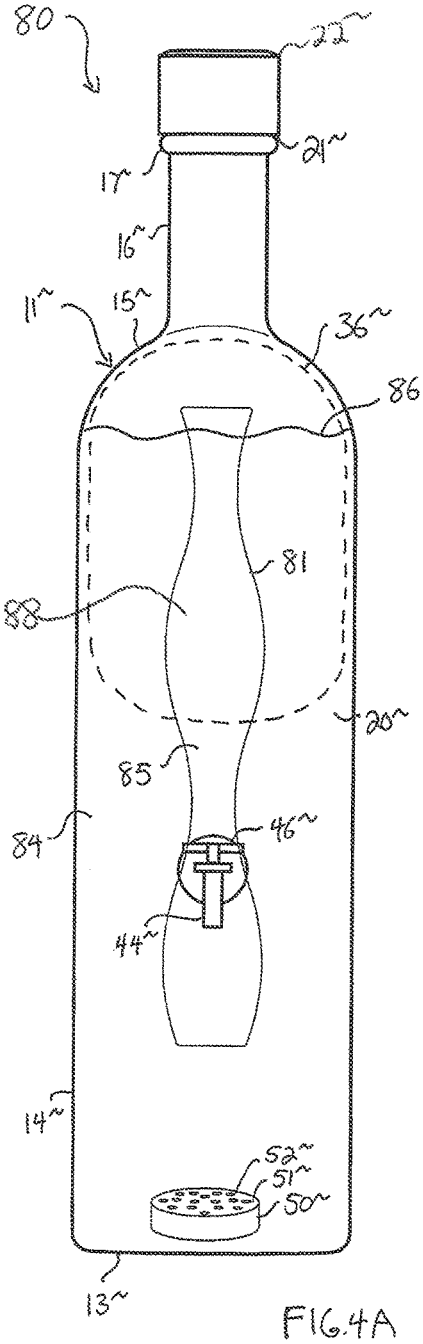
FIGS. 4A and 4B are front and right side elevation views of still another embodiment of a big bottle format dispenser, respectively, including an inner bladder in a contracted state.
Figure 4B:
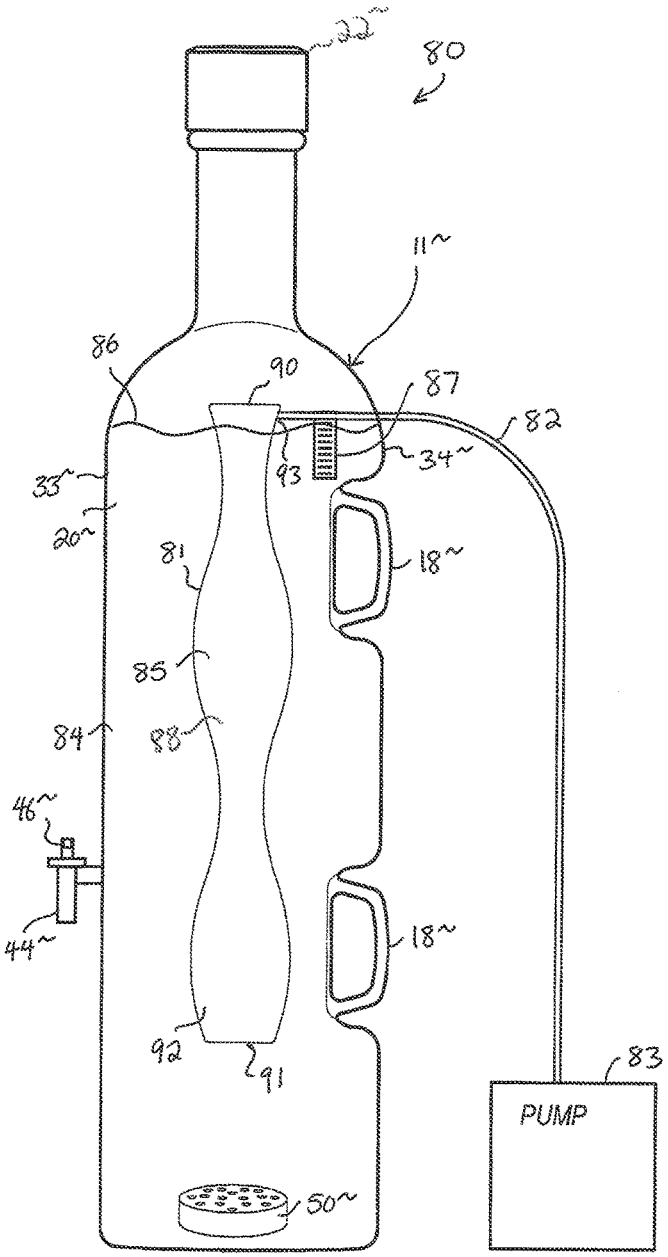
Figure 5A:
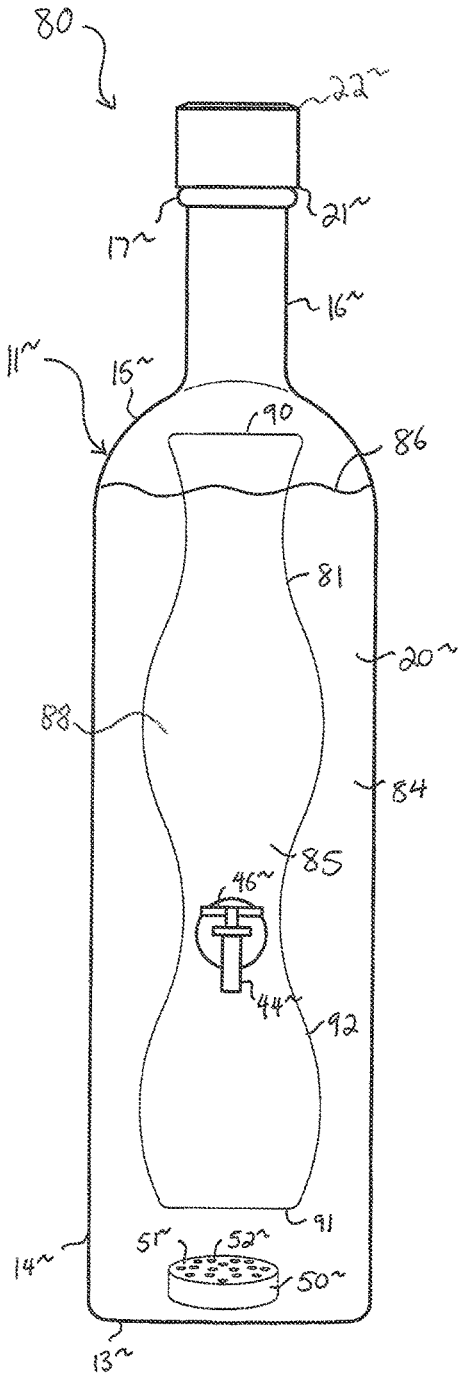
FIGS. 5A and 5B are front and right side elevation views, respectively, of the big bottle format dispenser of FIGS. 4A and 4B, illustrating the inner bladder in an expanded state.
Figure 5B:
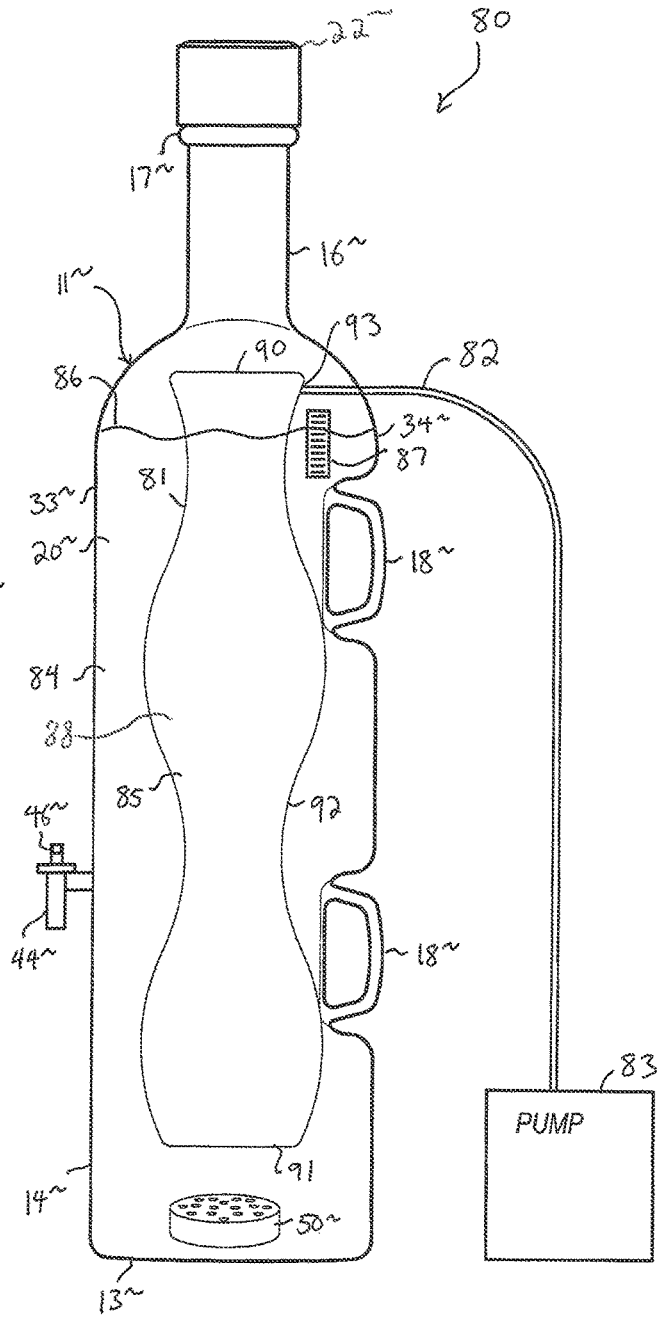

The spigot 44~ is carried in and coupled in fluid communication with the housing 11~ and not the bladder 81. As such, when the alcoholic beverage 84 is dispensed, the volume of the alcoholic beverage 84 in the housing 11~ decreases, and the level 86 drops. However, the bladder 81 is flexible and thus capable of significantly expanding and contracting in size. The bladder 81 has a top 90, a bottom 91, and a flexible sidewall 92 extending therebetween to form a continuous surface which is fluid impermeable. Bladder 81 may present an ornamental and artistic display with a configuration and arrangement of a branding indicator 88 of a manufacturer or distiller. The impermeable surface of the bladder 81 has a coupling 93 proximate to the top 90 where the line 82 connects to the bladder 81. FIGS. 4A and 4B illustrate the bladder 81 in a contracted state when there is still a relatively large amount of the alcoholic beverage 84 remaining in the dispenser 80. FIGS. 5A and 5B, however, show much of the alcoholic beverage 84 having been dispensed, and thus the bladder 81 is expanded to maintain the level 86 at the level sensor 87. By maintaining the level 86 at the level sensor 87, the dispenser 80 continuously looks full.

Figure 6:
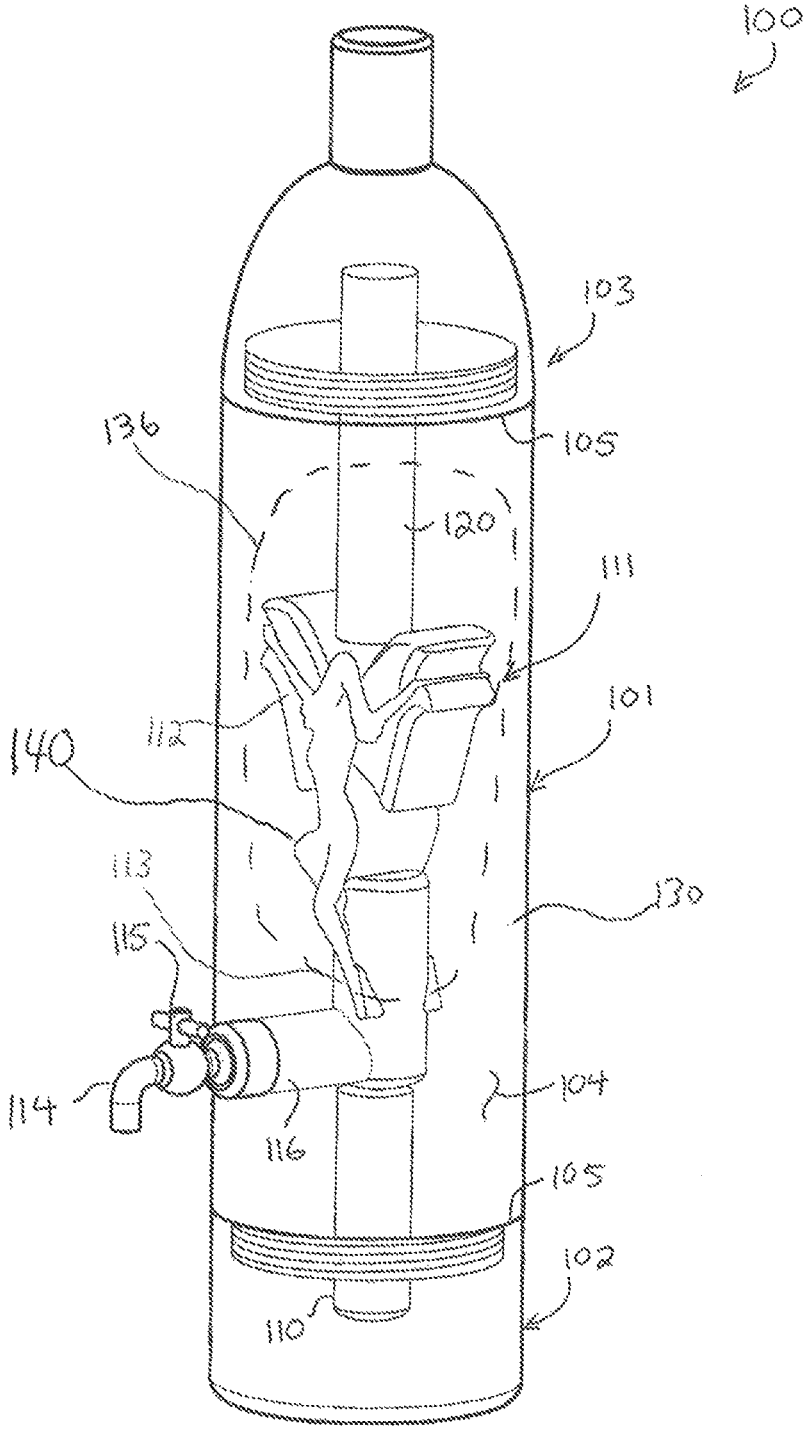
FIG. 6 is a front perspective view of yet still another embodiment of a big bottle format dispenser.

FIG. 6 is a front perspective view of an alternate embodiment of a big bottle format dispenser 100 similar to the dispenser 10. The dispenser 100 bears a number of similarities with the dispenser 10. The dispenser 100 includes a three-piece main assembly of a body 101, a base 102 on which the body 101 is mounted, and a cap 103 secured to the top of the body 101. The body 101, base 102, and cap 103 fit together to form a hollow interior 104, and the seams between the body 101 and base 102 and between the body 101 and cap 103 are secured with tamper-proof seals 105.

A stand 110 is formed integrally to and extends upwardly from the base 102. The stand 110 supports an inner reservoir 111, which includes a decorative upper reservoir 111 and a lower reservoir 112. The lower reservoir 112 is seated on, or otherwise secured to, the stand 110. The inner reservoir 111 preferably contains an alcoholic beverage, which, together with the configuration and arrangement of the inner reservoir 111, presents an ornamental and artistic display while complying with federal guidelines on liquor fill quantities. In many embodiments, this ornamental and artistic display will have the additional characteristic of marketing, as the configuration and arrangement of the inner reservoir 111 is that of a branding indicator for the manufacturer or distiller. While the inner reservoir 111 is preferably filled with an alcoholic beverage, the hollow interior 104 is preferably not filled with an alcoholic beverage. Indeed, in a preferred arrangement, the inner reservoir 111 contains an alcoholic beverage and the hollow interior 104 contains (but for the inner reservoir 111) a gas such as air. In another arrangement, the inner reservoir 111 contains an alcoholic beverage and the hollow interior 104 contains (but for the inner reservoir 111) a non-alcoholic beverage 130, such as water.

In the embodiment shown in FIG. 6, the upper reservoir 112 includes a molded figurine in the shape of a mascot 140, a highly stylized ornamentation of an angel, while the lower reservoir 113 is a plain cylinder. The lower reservoir 113 is coupled in fluid communication to a spigot 114, having a valve 115 (such as a ball valve), by a short tube 116. The tube 116 extends from proximate the bottom of the lower reservoir 113 to the sidewall of the body 101, where the spigot 114 is mounted. Fluid, such as an alcoholic beverage, contained within the inner reservoir 111, may pass from the interior space of the upper reservoir 112, down through the lower reservoir 113 and out the tube 116 to the spigot 114.

The inner reservoir 111 is supported primarily by the stand 110, though a pipe 120 does extend upwardly from the top of the upper reservoir 112 to the cap 103. In some embodiments, the pipe 120 is empty, closed, and not fillable. In other embodiments, the pipe 120 is joined in fluid communication with the upper reservoir 112 and contains additional alcoholic beverage in excess of that carried by the upper and lower reservoirs 112 and 113. In both embodiments, the pipe 120 serves also to anchor, support, and stabilize the inner reservoir 111 within the body 101.

As with the other embodiments, the dispenser 100 also includes additional elements such as a transparent window and a light, though those are not shown in this drawing; one having ordinary skill in the art will readily appreciate their existence and location based on the earlier discussion of the other embodiments of dispensers.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A device comprising: a housing in a form factor of a bottle, the housing defining an outer reservoir; an inner reservoir carried within the housing; wherein the inner reservoir is in a form factor of a molded figurine; wherein the molded figurine is a branding indicator; a window in a front of the housing exposing the inner reservoir; wherein the inner reservoir is filled with an alcoholic beverage; and wherein the outer reservoir is not filled with an alcoholic beverage; wherein the housing further comprises a cap and a base and a mid-section wherein tamper proof seals are located at joints between the mid-section and each of the cap and the base.

2. The device of claim 1, further comprising a spigot carried by the outer reservoir, wherein the spigot is coupled in fluid communication with the inner reservoir and is isolated from fluid communication with the outer reservoir.

3. The device of claim 1, further comprising illumination means in the outer reservoir configured to illuminate the inner reservoir.

4. The device of claim 3, wherein the alcoholic beverage in the inner reservoir fluoresces in response to illumination by the illumination means.

5. The device of claim 1, wherein the inner reservoir has a volume selected form the group consisting of 1.75 liters, 1 liter, 750 milliliters, 375 milliliters, 200 milliliters, 100 milliliters, and 50 milliliters.

6. The device of claim 1, wherein the outer reservoir is filled with a fluid liquid which is not an alcoholic beverage.

7. The device of claim 1, wherein said housing is in the form factor of a bottle shape.

8. The device of claim 1, wherein said inner reservoir comprises the form factor of a logo.

9. The device of claim 1, wherein said inner reservoir comprises the form factor of a mascot.

10. The device of claim 1, wherein said inner reservoir comprises the form factor of an angel.

11. The device of claim 1, further comprising a removeable cap, structured to be removable, thereby allowing access into the inner reservoir.

* * * * *